US006262754B1

(12) United States Patent
Watanabe et al.

(10) Patent No.: US 6,262,754 B1
(45) Date of Patent: Jul. 17, 2001

(54) DUAL TYPE THERMAL PRINTER

(75) Inventors: Hideki Watanabe; Akihiko Ito, both of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/490,834

(22) Filed: Jan. 25, 2000

(30) Foreign Application Priority Data

Jan. 27, 1999 (JP) ..... 11-018969

(51) Int. Cl.[7] ..... B41J 2/32

(52) U.S. Cl. ..... 347/171; 400/584; 400/585; 400/586; 400/588

(58) Field of Search ..... 347/171, 197; 400/120.16, 120.17, 584, 585, 586, 588

(56) References Cited

U.S. PATENT DOCUMENTS 4,984,914 1/1991 Hayakawa ..... 400/585
5,087,926 2/1992 Wakui ..... 346/76

FOREIGN PATENT DOCUMENTS 2294054 7/1976 (FR) .

OTHER PUBLICATIONS

Patent Abstracts of Japan, published Jan. 6, 1998 by European Patent Office, Publication No. 63001565.
Patent Abstracts of Japan, published Nov. 16, 1985 by European Patent Office, Publication No. 60230876.

*Primary Examiner*—Huan Tran
(74) *Attorney, Agent, or Firm*—Adams & Wilks

(57) ABSTRACT

A dual type thermal printer comprises a main body frame, a first platen roller supported by the main frame for undergoing rotation, and a second platen roller supported by the main body frame in coaxial relation to the first platen roller for undergoing rotation independently from the first platen roller. A thermal head is supported by the main body frame for undergoing pivotal movement into and out of pressure contact with the first and second platen rollers. A print paper feeding mechanism separately feeds print paper to a first space between the first platen roller and the thermal head and to a second space between the second platen roller and the thermal head. An adjusting device adjusts a width of each of the first and second spaces to accommodate print paper of varying width sizes.

20 Claims, 5 Drawing Sheets

DUAL TYPE THERMAL PRINTER

BACKGROUND OF THE INVENTION

The present invention relates to a printing apparatus and a multiple type printing apparatus capable of printing on a plurality of pieces of paper. More specifically, the present invention relates to a technique effective when applied to, for example, a thermal printing apparatus provided with a thermal head (what is known as a thermal printer).

Printers used as information output apparatuses are broken down into impact printers, such as wire dot printers, and non-impact printers. Non-impact printers include laser printers and thermal printers. Since impact printers make a high amount of noise and are inferior in print quality, non-impact printers have been more popularly used recently. Among non-impact printers, thermal printers are suited for miniaturization, and thus, they have been used in a wide range of fields.

In particular, in the field of POS (point-of-sales) terminals, since output paper for a receipt to be handed to a customer and output paper for a journal to be kept as a copy for the shop have to be printed simultaneously, two printers are provided in parallel with each other or a dual type printer that has two heads has been put to practical use. However, since a printhead for a printer is expensive, with a multiple, type printer having heads for the respective paper, though it can be made compact to some extent, satisfactory effects with regard to cost can not be obtained.

Accordingly, an invention has been proposed with regard to a dual type thermal printer. which, by sharing a thermal head and providing two paper feed units in parallel with each other with respect to the shared thermal head, attains improvement with regard to both miniaturization and economical efficiency (Japanese Patent No. 2819595).

However, though the thermal printer according to the invention described in Japanese Patent No. 2819595 has an advantage that it is a low-priced apparatus capable of printing on two pieces of paper simultaneously, since it has only one drive roller and one motor, and the guide portion of its paper feed mechanism is fixed, the width of paper to be printed is fixed and the print speed has to be the same with regard to the two systems, and thus, it is found that there is a problem that the printer is difficult to use for general purposes.

Especially with regard to POS terminals, there are many cases where the outputted information and the amount thereof are required to be different between output paper for a receipt to be handed to a customer and output paper for a journal to be kept as a copy for the shop. Accordingly, when the thermal printer according to the patented prior invention mentioned in the above is used for a POS terminal, two kinds of such printers must be prepared for two kinds of paper different in size ratio, preventing drastic decrease in the cost.

In addition, since the thermal printer according to the invention described in Japanese Patent No. 2819595 has only one drive roller and one motor, the print speed for the two kinds of paper can not be made different. Therefore, it is found that, in case the difference in the amount of the outputted information is large, i.e., the amount of the information is extremely different, there is a problem that paper having smaller amounts of information wastes large blank portions of the paper.

SUMMARY OF THE INVENTION

Accordingly, an object of the present invention is to provide a dual type thermal printer capable of changing the size ratio of paper to be used, and thus, capable of decreasing the total cost.

Another object of the present invention is to provide a dual type thermal printer capable of making different the print speed for two kinds of paper and thus, capable of accommodating a case where the difference in the amount of the outputted information is large without changing the size ratio of paper so much.

Still another object of the present invention is to provide a dual type thermal printer capable of avoiding excessive waste blank portions of paper having the smaller amount of information.

The present invention is made in view of the above problems. According to the present invention, a dual type thermal printer comprises two platen rollers positioned coaxially and rotatably supported independently of each other and disposed in parallel with one opposing thermal head, paper feed means for separately transporting heat sensitive paper inserted between these platen rollers and the thermal head, respectively, and a movable frame for holding the thermal head, the movable frame having regulating pieces at both ends thereof for regulating end portions of the heat sensitive paper and being slidably attached in the axial direction of the platen rollers.

According to the present invention, by just sliding the movable frame, the size of paper to be used can be changed. Further, since the two platen rollers and the paper feed means for separately transporting heat sensitive paper are provided, the paper feed speed for the two pieces of heat sensitive paper can be made different.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERRED EMBODIMENT

A preferred embodiment of the present invention will now be described with reference to the drawings.

Figure 1:
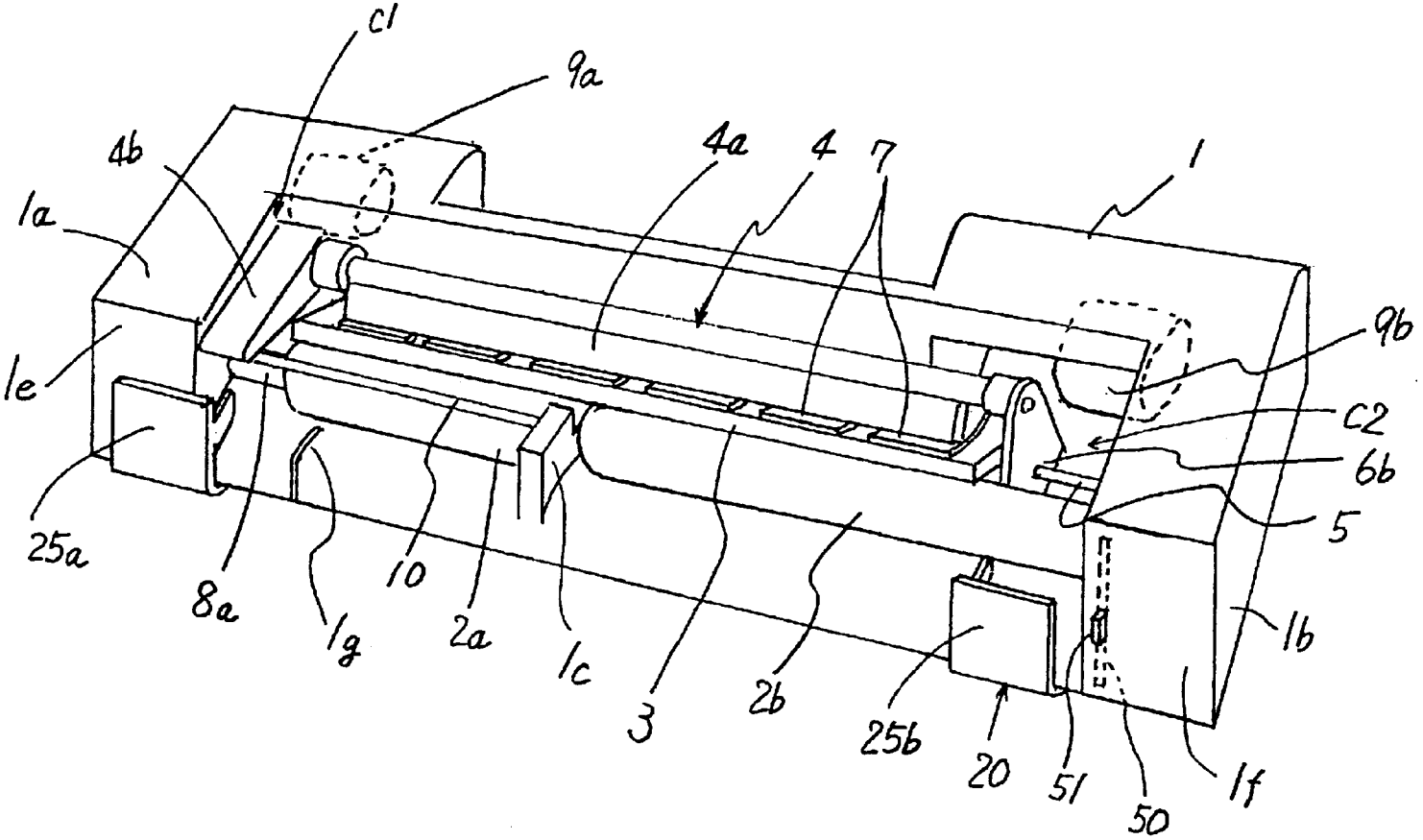
FIG. 1 is a perspective view showing an embodiment of a thermal printer according to the present invention.
Figure 2:
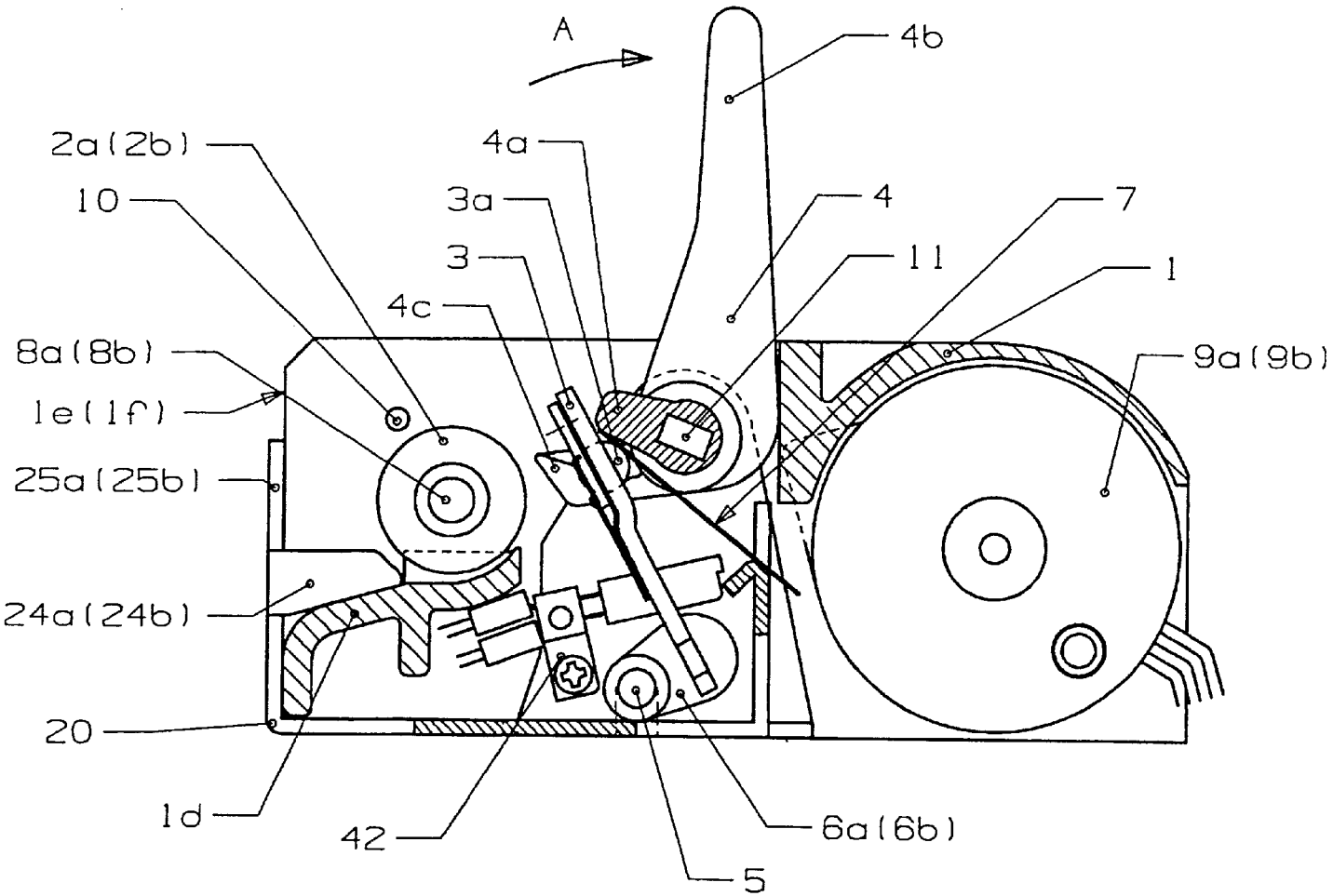
FIG. 2 is a sectional side view illustrating a thermal head, in the thermal printer of the embodiment shown in FIG. 1, pivated away from a platen roller.
Figure 3:
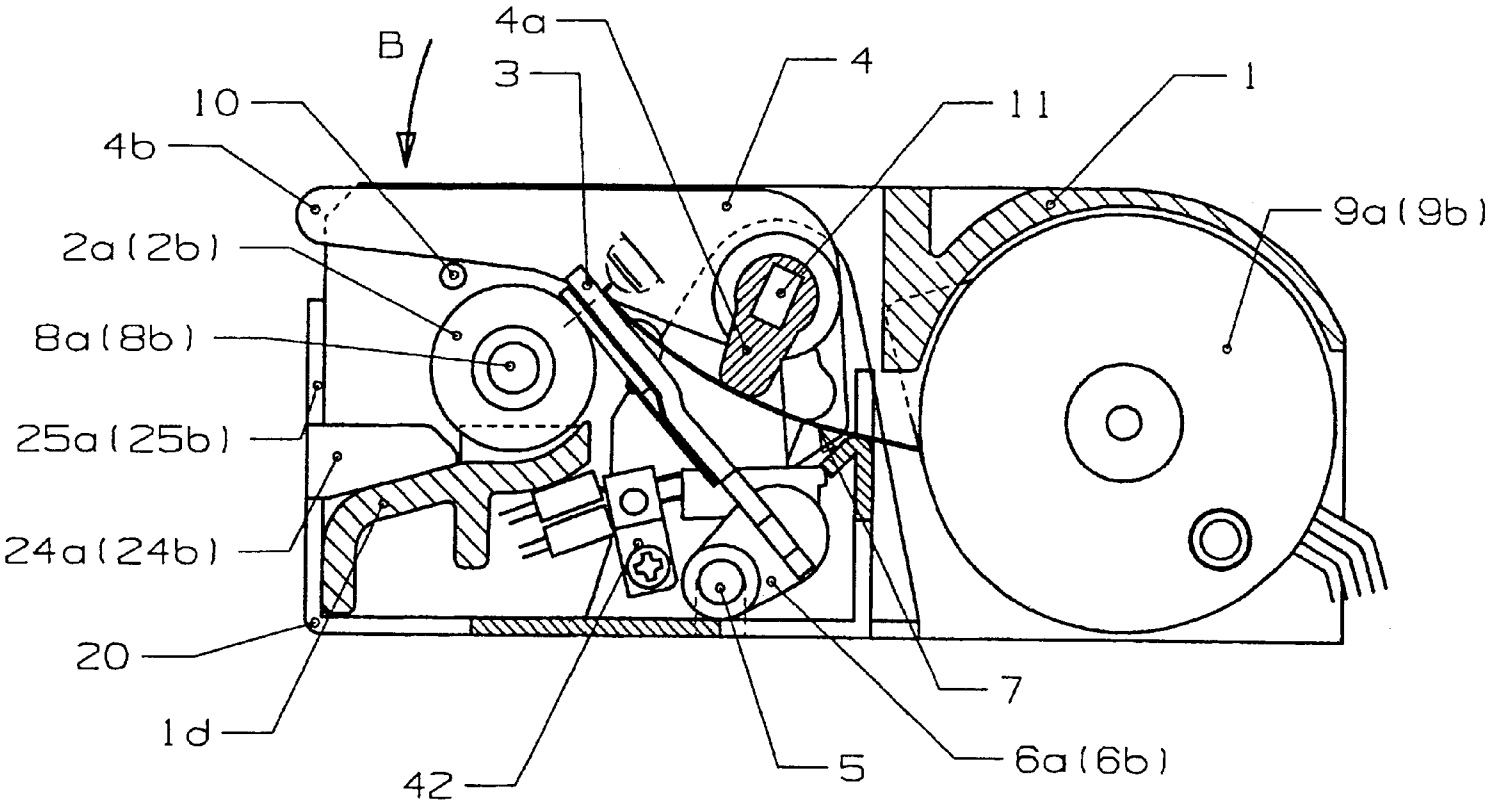
FIG. 3 is a sectional side view illustrating the thermal head, in thermal printer of the embodiment shown in FIG. 1, pressed against the platen roller.

FIG. 1 is a perspective view showing an embodiment of a thermal printer according to the present invention. FIG. 2 is a sectional side view illustrating a thermal head pivated away from a platen roller. FIG. 3 is a sectional side view illustrating the thermal head pressed against the platen roller.

In FIG. 1, reference symbol 1 denotes a main body frame of the printer, 2*a* and 2*b* denote platen rollers provided horizontally at a front end portion of the main body frame 1, 3 denotes a line dot type thermal head attached to the main body 1 frame approachably to and separably from the platen rollers 2*a* and 2*b*, and 4 denotes a rotating and pressing member for making the thermal head 3 approach to and away from the platen roller 2. The rotating and pressing member 4 has a pressing piece 4a positioned at the rear surface of the thermal head 3 and an operating lever 4*b* provided on one side thereof so as to protrude upward. The main body frame 1 is formed of plastic, and the outer peripheral surfaces of the platen rollers 2*a* and 2*b* are covered with an elastic material.

As shown in FIG. 2, the thermal head 3 is fixed between a pair of head supporting pieces 6*a* and 6*b* on the left and right sides fitted to a head supporting shaft 5 disposed at a center lower portion of the main body frame 1, and is held so as to be rotatable about the head supporting shaft 5. When assembled, the thermal head 3 is pivated away from the platen roller 2 as shown in FIG. 2. The thermal head 3 is configured to be pressed against the platen rollers 2*a* and 2*b* by pushing forward the operating lever 4*b* as shown by an arrow B in FIG. 3. In this embodiment, a plurality of leaf springs 7 are fixedly attached to the rear surface of the thermal head 3, though the present invention is not limited thereto. The tip sides of the leaf springs 7 are in contact with a rear wall 25 of a movable frame 20 described in the following. By this construction, when the operating lever 4*b* is pushed forward, the pressing piece 4*a* rotates and at the same time, presses the leaf springs 7 forward, curving the leaf springs 7, as shown in FIG. 3 such that the thermal head 3 is pressed against the platen roller 2 at predetermined pressure caused by the elastic force of the leaf springs 7.

Also, as shown in FIG. 2, a pushing-up piece 4*c* is provided at a lower end of the operating lever 4*b*, and an engaging pin 3*a* is provided on one side of the thermal head 3 so as to protrude sideward. When the operating lever 4*b* is rotated backward as shown by an arrow A, immediately after the pressing piece 4*a* comes out of contact with the leaf springs 7, the pushing-up piece 4*c* comes in contact with and pushes up the engaging pin 3*a*, thereby compulsorily. moving the thermal head 3 away from the platen roller 2.

In this embodiment, the platen roller 2 is, as shown in FIG. 1, divided into two: a first platen roller 2*a* axially supported by a rotational shaft 8a between a side wall portion 1*a* of the main body frame 1 and a supporting wall 1*c* provided at the center of the front end of the frame; and a second platen roller 2*b* axially supported by a rotational shaft 8*b* between a side wall portion 1*b* and the supporting wall 1*c*. In this embodiment, the platen roller 2*a* is formed so as to be shorter than the platen roller 2*b*, though the present invention is not limited thereto.

Drive motors 9*a* and 9*b* are attached to both sides of a back end portion of the main body frame 1 correspondingly to the two divided platen rollers 2*a* and 2*b*, respectively. It is structured such that the rotational driving force of the drive motors 9*a* and 9*b* are transmitted to the platen rollers 2*a* and 2*b* by reduction gear mechanisms built in the side wall portions 1*a* and 1*b* of the main body frame 1, respectively.

It is to be noted that a pin 10 horizontally provided between the side wall portion 1*a* of the main body frame 1 and the supporting wall 1*c* and substantially in parallel with and a little above the platen roller 2*a* is a stopper for regulating the forward position of the operating lever 4*b*. The pin 10 also has a function to, when a cutter is attached in front of the platen roller 2*b*, introduce paper after printing so that the paper forms a predetermined angle with regard to the cutter. The pin 10 is provided only on the side of the platen roller 2*a* because it is assumed that, when the printer is used for a POS terminal, paper on the left side is used for a journal of the shop to be kept as a record and paper on the right side is for a receipt to be handed to a customer, and thus, it is assumed that a cutter is attached only to the right side.

On the other hand, though the thermal head 3 is integrally formed so as to oppose both of the platen rollers 2*a* and 2*b* as shown in FIG. 1, its length is set so as to be a little shorter than the total of the widths of the platen rollers 2*a* and 2*b* and the space between the platen rollers 2*a* and 2*b*. It is to be noted that the difference between the length of the thermal head 3 and the above total length of the platen rollers is determined according to the amount of the slide of the thermal head described in the following. In other words, the length of the thermal head 3 is the total length of the platen rollers minus the amount of the slide of the thermal head.

Next, a sliding mechanism of the thermal head 3 is described.

Figure 4:
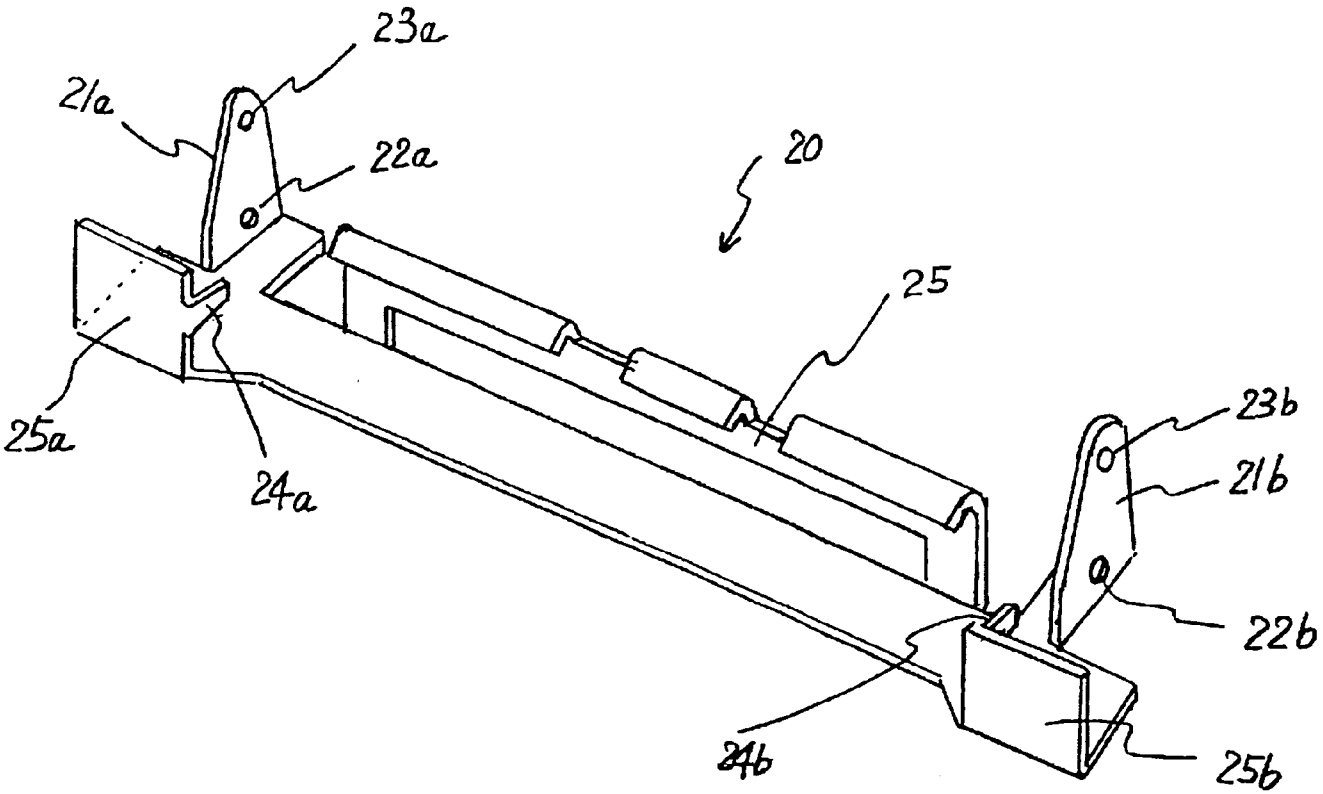
FIG. 4 is a perspective view showing a specific example of a movable frame.

In this embodiment, a movable frame 20 made of a conductive material is attached to a front end lower surface of the main body frame 1. As shown in FIG. 4, movable frame 20 has at both ends thereof a pair of retaining pieces 21*a* and 21*b* bent upward as shown in FIG. 4, and is configured to be slidable to the left and to the right of the main body frame 1 by fitting through holes 22*a* and 22*b* formed in lower portions of the retaining pieces 21*a* and 21*b* to the head supporting shaft 5. Further, a supporting pin 11 for rotatably supporting the rotating and pressing member 4 is horizontally provided between engagement holes 23*a* and 23*b* formed in tip portions of the retaining pieces 21*a* and 21*b*.

It is to be noted that the pair of head supporting pieces 6*a* and 6*b* on the left and right sides for supporting the thermal head 3 is fitted to the head supporting shaft 5 inside the retaining pieces 21*a* and 21*b* at both ends of the movable frame 20. When the frame 20 is moved along the head supporting shaft 5 with the operating lever 4*b* held up as shown in FIG. 2, since the retaining pieces 21*a* and 21*b* laterally pushes the head supporting pieces 6*a* and 6*b*, the thermal head 3 is slid together.

Further, regulating pieces 24*a* and 24*b* for regulating ends of paper are provided in the movable frame 20, and the width of paper to be used is determined by the space between the regulating pieces 24a and 24*b* and the supporting wall 1*c* at the front end of the main body frame. When the movable frame 20 is slid, since the space between the regulating piece 24*a* and the supporting wall 1c and the space between the regulating piece 24*b* and the supporting wall 1*c* change simulatenously, the respective widths of paper to be fed by the platen rollers 2*a* and 2*b* are changed. Thus, by adjusting the movable frame 20 and corresponding regulating pieces 24*a* and 24*b* as described above, the width of the space between the regulating piece 24*a* and the supporting wall 1*c* and the space between the regulating piece 24*b* and the supporting wall 1*c* can be adjusted to accomodate paper of varying width sizes.

More specifically, in a state where the movable frame 20 is moved to the left in FIG. 1, the space between the regulating piece 24*a* and the supporting wall 1*c* equals the space between the regulating piece 24*b* and the supporting wall 1*c* , so that the platen rollers 2*a* and 2*b* are capable of feeding heat sensitive paper for printing having the same width. On the other hand, in a state where the movable frame 20 is moved to the right in FIG. 1, the space between the regulating piece 24*a* and the supporting wall 1*c* is made smaller and the space between the regulating piece 24*b* and the supporting wall 1*c* is made larfer, so that the platen roller 2*b* feeds heat sensitive paper for printing wider than that for the platen roller 2*a*. In other words, by sliding the movable frame 20 to the left or to the right, the corresponding space between the supporting wall 1*c* and each of the regulating pieces 24*a* and 24*b* can be adjusted, and the combination of the widths of heat sensitive paper to be used can be changed.

In addition, in this embodiment, the regulating pieces 24*a* and 24*b* are formed such that the lower ends thereof are in contact with a guide wall 1*d* provided at the front end of the main body frame 1. Further, guide pieces 25*a* and 25*b* opposing side front walls 1*e* and if of the main body frame 1 are projectingly provided at a front end of the movable frame 20. These regulate the rotation of the movable frame 20 about the head supporting shaft 5 to make the movable frame 20 slidable to the right and to the left in a stable posture.

Figure 5:
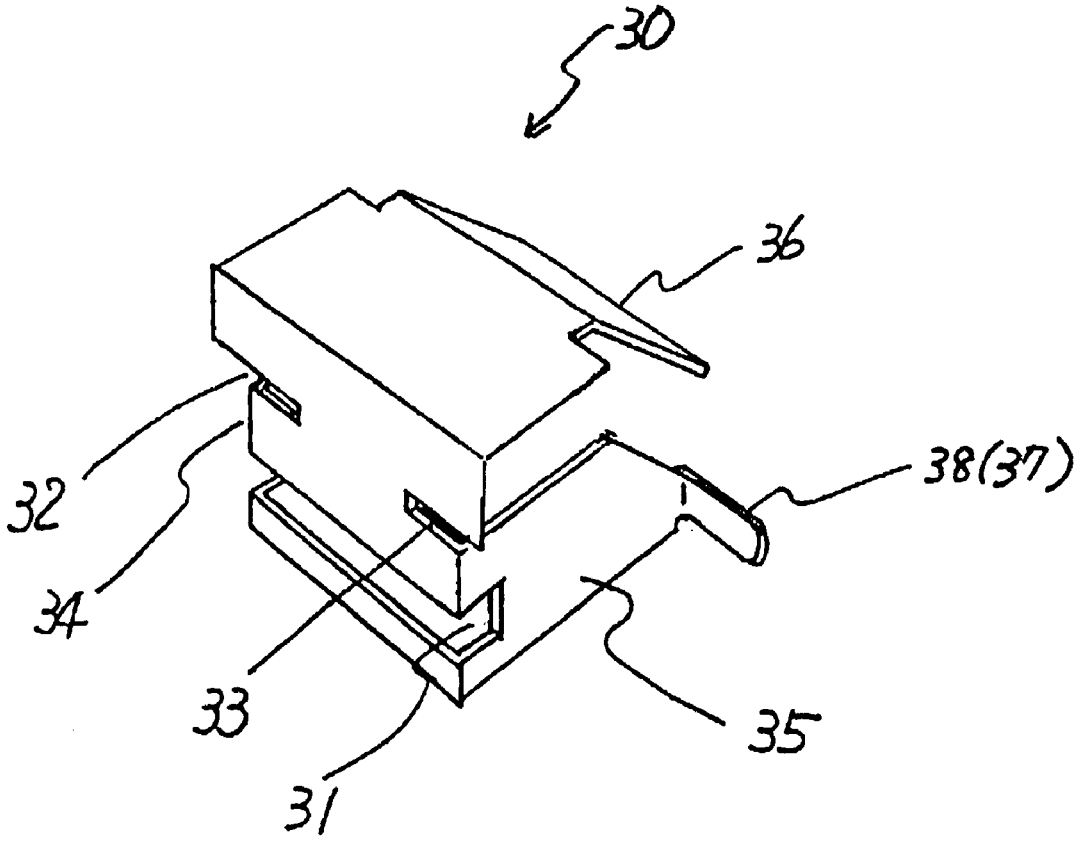
FIG. 5 is a perspective view showing a specific example of a stopper and conducting member inserted into a space between the movable frame and a main body frame.

In this embodiment, in a state where the movable frame 20 is moved to either end, a stopper and conducting member 30 made of a conductive metal plate or the like and having a shape as shown in FIG. 5 is detachably inserted from below the main frame 1 into a space C2 (or C1) between the movable frame 20 and an inner surface of a side wall portion of the main body frame 1, through the present invention is not limited thereto. Though, in FIG. 1, the space between the movable frame 20 and the inner surface of the side wall portion of the main body frame 1 is denoted by C2, in a state where the movable frame 20 is slid to the right end, i.e., oppositely to the case shown in FIG. 1, such a space C1 is on the opposite side (on the left side), and thus, the stopper and conducting member 30 is symmetrically shaped so as to be insertable into both of the left space and the right space.

A substantially rectangular notch 31 at a front lower portion of the stopper and conducting member 30 shown in FIG. 5 is formed so as to be capable of engaging with the head supporting shaft 5. Notches 32 and 33 formed from both ends in the middle toward the center are for facilitating curving of both wing pieces 34 and 35 in attachment and detachment. Further, a contact piece 36 provided so as to extend diagonally downward from an upper end and stopper pieces 37 and 38 bent outward from tip portions of the both wing pieces 34 and 35 are provided in the stopper and conducting member 30.

Among them, the stopper piece 37 or 38 is engaged with an engagement hole formed in proximity to a motor attaching portion on an inner surface of a side wall portion of the main body frame 1 to prevent misalignment of the stopper and conducting member 30. On the other hand, the contact piece 36 is pressed against and in contact with a housing made of metal for the drive motor 9*a* or 9*b* by the elastic force of the stopper and conducting material 30 in a state where it is inserted in the space C1 or C2.

Further, the wing pieces 34 and 35 of the stopper and conducting member 30 are in contact with the retaining pieces 21*a* and 21*b* at both ends of the movable frame 20, and is assembled such that the movable frame 20 is in contact with the tips of the leaf springs 7 at the rear surface when the thermal head 3 is pressed against the platen rollers 2*a* and 2*b*. This makes the electric potential of the housing of the drive motor 9*a* or 9*b* equal to that of the thermal head 3. Further, as shown in FIG. 1, a sheet metal 50 formed such that its front end has a protrusion 51 a tip of which protrudes from the side front wall surface 1*f* (1*e*) and its back end reaches the position where the drive motor 9*b* (9*a*) is attached is attached in each of the inner walls of the side wall portions 1*b* (1*a*) of the main body frame 1. The drive motor 9*b* (9*a*) is fixed to the sheet metal 50 with a screw, and the guide piece 25*b* (25*a*) of the movable frame 20 is configured so as to be contactable therewith. This makes the electric potential of the drive motor 9*a* or 9*b* without the stopper and conducting member 30 inserted therein equal to that of the movable frame 20 through the sheet metal 50. By grounding them through an earth wire (not shown), breakage of the thermal head due to static electricity is prevented.

It is to be noted that, in FIGS. 2 and 3, reference symbol 42 denotes a detector formed of a microswitch and the like for detecting whether the thermal head 3 is in the up state or in the pressed state.

Next, the method of using the thermal printer according to the above embodiment is described.

The thermal printer of this embodiment has two set states: a first set state where the movable frame 20 is moved to the left end with the stopper and conducting member 30 inserted in the space C2; and a second set state where the movable frame 20 is moved to the right end with the stopper and the conducting member 30 inserted in the opposite space (C1). In the second set state, the effective width of printing of the left platen roller 2*a* is smaller than that in the first set state, and, in contrast, the effective width of printing of the right platen roller 2*b* is larger.

As described above, the thermal printer of this embodiment is provided with the drive motors 9*a* and 9*b* for the platen rollers 2*a* and 2*b*, respectively. This makes it possible for the respective platen rollers 2*a* and 2*b* to control the paper feed amount, that is, the print speed, and the size of the printed characters independently of each other. As a result, the necessity to prepare two kinds of printing apparatus for two sheets of print paper different in width ratio as with a conventional thermal printer is eliminated, a single printer that can cope with two sheets of print paper different in width ratio can be provided, and thus, the total cost can be lowered.

It is to be noted that, though in the above embodiment, lateral movement of the movable frame 20 in operation is prevented by inserting the stopper and conducting member 30 into the space C1 or C2 between the movable frame 20 and a side wall portion of the main body frame 1 with the movable frame 20 slid to one end, the means for preventing movement of the movable frame 20 is not limited thereto.

For example, in the embodiment shown in FIG. 1, slits for engagement lg (the right slit is not seen because the regulating piece 24*b* is in engagement therewith) are provided on the front end surface of the main body frame 1 so as to oppose the regulating pieces 24*a* and 24*b* when the movable frame 20 is moved to the left end and to the right end, respectively, and movement of the movable frame 20 can be fairly prevented just by the slits for engagement 1*g*. However, it is to be noted that, as in this embodiment, by inserting the stopper and conducting member 30 into the space C1 or C2 between the movable frame 20 and a side wall portion of the main body frame 1, movement of the movable frame 20 can be prevented with more certainty.

Further, though the driving force of the drive motors is transmitted to the platen rollers to rotate in this embodiment, a paper feed roller may be provided separately from the platen rollers.

As described in the above, a thermal printer according to the invention comprises a main body frame, one thermal head, first and second platen rollers provided in parallel with the thermal head, positioned coaxially, and rotatably supported independently of each other, paper feed means capable of separately transporting two pieces of heat sensitive paper inserted between the first platen roller and the thermal head and between the second platen roller and the thermal head, respectively, and a movable frame for holding the thermal head and, having a pair of regulating pieces at both ends thereof for regulating end portions of the heat sensitive paper and slidably attached in the axial direction of the platen rollers. By this construction the size of paper to be used can be changed just by sliding the movable frame, and the feed speed of the two sheets of paper can be made different.

According to the invention, a supporting wall is provided between the first platen roller and the second platen roller of the main body frame, a supporting shaft of the first platen roller is provided horizontally between the supporting wall and one side wall portion of the main body frame, a supporting shaft of the second platen roller is provided horizontally between the supporting wall and the other sidewall portion of the main body frame, and side surfaces of the supporting wall form guide surfaces for regulating the other end portions of the two pieces of heat sensitive paper inserted between the first platen roller and the thermal head and between the second platen roller and the thermal head, respectively. By this construction the supporting wall of the platen rollers can also serve as a guide member of heat sensitive paper, making the configuration simpler.

According to the invention, a stopper member insertable into any space between the movable frame and a side wall portion of the main body frame with the movable frame slid to one end is provided. By this construction movement of the movable frame in operation is prevented with certainty, and in addition, since only one stopper member is necessary, the number of parts is small.

According to the invention, the paper feed means comprises two drive motors provided correspondingly to the platen rollers and two sets of reduction gear mechanisms for transmitting driving force of the drive motors, respectively. By this construction, output to two sheets of paper with the print speed and the size of the printed characters can be changed.

According to the invention, the stopper member is formed of a conductive material and is configured such that, in an inserted state, a portion thereof is in contact with a conductive housing of one of the drive motors forming the paper feed means. By this construction the electric potential of the movable frame is made to be equal to that of the housing of the drive motor through the stopper member, and grounding as measures against static electricity is made easier.

According to the invention, an elastic member for pressing the thermal head against the platen rollers is disposed on a rear surface of the thermal head, and a portion of the elastic member is in contact with the movable frame. By this construction, the electric potential of the thermal head is made to be equal to that of the movable frame and that of the housing of the drive motor, and the grounding is further made easier.

According to the invention, the movable frame is configured to have guide pieces in contact with a surface of the main body frame, the surface being formed in parallel with the supporting shafts of the platen rollers. By this construction, the movable frame can be slid with stability.

According to the invention, a head up/down mechanism is provided at the back of the thermal head for pressing the thermal head against the platen rollers or moving the thermal head away from the platen rollers by rotation of an operating lever, and a positional regulation pin for regulating the rotational position of the operating lever is provided in the vicinity of a platen roller on the side where the operating lever is disposed so as to be in parallel with the platen rollers. By this construction, the force pressing the thermal head against the platen rollers can be made constant.

According to the invention, the operating lever and the positional regulation pin are provided so as to be in parallel with one platen roller having a smaller distance from the thermal head when the movable frame is slid. By this construction, the positional regulation pin can also serve as an introducing member of the paper, and the number of parts can be decreased.

According to the invention, the length of the thermal head is set so as to be shorter than the total of the widths of the first and second platen rollers and the space. By this construction the length of the thermal head can be made minimum and the cost can be lowered.

What is claimed is:

1. A dual type thermal printer comprising: a main body frame; a thermal head mounted on the main body frame; first and second platen rollers disposed in coaxial relation relative to one another and in parallel relation relative to the thermal head, the first and second platen rollers being mounted on the main body frame for undergoing rotation independently of each other; paper feed means for separately transporting two pieces of heat sensitive paper inserted between the first platen roller and the thermal head and between the second platen roller and the thermal head, respectively; and a movable frame for supporting the thermal head and mounted on the main body frame for undergoing sliding movement in an axial direction of the first and second platen rollers, the movable frame having a pair of regulating pieces at opposite ends thereof for regulating end portions of the heat sensitive paper.

2. A dual type thermal printer as claimed in claim 1; further comprising a supporting wall disposed provided between the first platen roller and the second platen roller; and wherein a supporting shaft of the first platen roller is disposed horizontally between the supporting wall and a side wall portion of the main body frame, a supporting shaft of the second platen roller is disposed horizontally between the supporting wall and another side wall portion of the main body frame, and side surfaces of the supporting wall define guide surfaces for regulating other end portions of the two pieces of heat sensitive paper inserted between the first platen roller and the thermal head and between the second platen roller and the thermal head, respectively.

3. A dual type thermal printer as claimed in claim 2; further comprising a stopper member insertable into a space disposed between the movable frame and a side wall portion of the main body frame.

4. A dual type thermal printer as claimed in claim 3; wherein the paper feed means comprises two drive motors each connected to a respective one of the first and second platen rollers and two sets of reduction gear mechanisms each for transmitting a driving force of a respective one of the drive motors.

5. A dual type thermal printer as claimed in claim 4; wherein the stopper member is comprised of a conductive material and has a portion for contacting a conductive housing of one of the drive motors in an inserted state of the stopper member.

6. A dual type thermal printer as claimed in claim 5; further comprising an elastic member for pressing the thermal head from a rear surface thereof into pressure contact with the first and second platen rollers, the elastic member having a portion for contacting the movable frame.

7. A dual type thermal printer as claimed in claim 1; further comprising a pair of supporting shafts each for supporting a respective one of the first and second platen rollers for undergoing rotation relative to the main body frame; and wherein the movable frame has guide pieces for contacting a surface of the main body frame which is disposed parallel to the supporting shafts of the first and second platen rollers.

8. A dual type thermal printer as claimed in claim 1; further comprising a head up/down mechanism having an operating lever and being disposed behind the thermal head for pressing the thermal head into and out of pressure contact with the first and second platen rollers by rotation of the operating lever; and further comprising a positional regulation pin for regulating a rotational position of the operating lever, the positional regulation pin being disposed in the vicinity of one of the first and second platen rollers on a side where the operating lever is disposed so as to extend parallel to the first and second platen rollers.

9. A dual type thermal printer as claimed in claim 8; wherein the operating lever and the positional regulation pin are mounted on the main body frame so as to extend parallel to one of the first and second platen rollers which is disposed closer to the thermal head when the movable frame is slid.

10. A dual type thermal printer as claimed in claim 1; wherein a length of the thermal head is shorter than a total of the widths of the first and second platen rollers and a space disposed therebetween.

11. A dual type thermal printer as claimed in claim 1; further comprising a stopper member insertable into a space disposed between the movable frame and a side wall portion of the main body frame.

12. A dual type thermal printer as claimed in claim 1; wherein the paper feed means comprises two drive motors each connected to a respective one of the first and second platen rollers and two sets of reduction gear mechanisms each for transmitting a driving force of a respective one of the drive motors.

13. A dual type thermal printer as claimed in claim 2; wherein the paper feed means comprises two drive motors each connected to a respective one of the first and second platen rollers and two sets of reduction gear mechanisms each for transmitting a driving force of a respective one of the drive motors.

14. A dual type thermal printer as claimed in claim 2; wherein the movable frame has guide pieces for contacting a surface of the main body frame which is disposed parallel to the supporting shafts of the first and second platen rollers.

15. A dual type thermal printer comprising: a main body frame; a first platen roller supported by the main frame for undergoing rotation; a second platen roller supported by the main body frame in coaxial relation to the first platen roller for undergoing rotation independently from the first platen roller; a thermal head supported by the main body frame for undergoing pivotal movement into and out of pressure contact with the first and second platen rollers; print paper feeding means for separately feeding print paper to a first space between the first platen roller and the thermal head and to a second space between the second platen roller and the thermal head; and adjusting means for adjusting a width of each of the first and second spaces to accommodate print paper of varying width sizes.

16. A dual type thermal printer according to claim 15; further comprising at least one biasing member having a biased state in which the biasing member resiliently biases the thermal head into pressure contact with the first and second platen rollers, and an unbiased, relaxed state in which the thermal head is released from pressure contact with the first and second platen rollers.

17. A dual type thermal printer according to claim 16; further comprising a pressing member pivotally supported relative to the main body frame for applying pressure to the biasing member to place the biasing member in the biased state; and an operating lever for pivoting the pressing member in a first direction to apply pressure to the biasing member to place the biasing member in the biased state and for pivoting the pressing member in a second direction to release the pressure applied to the biasing member to place the biasing member in the unbiased, relaxed state whereby the thermal head is released from pressure contact with the first and second platen rollers.

18. A dual type thermal printer according to claim 15; wherein the adjusting means comprises a movable frame mounted on the main body frame for undergoing sliding movement in an axial direction of the first and second platen rollers, the movable frame having a pair of regulating pieces for regulating the width of each of the first and second spaces.

19. A dual type thermal printer according to claim 18; further comprising a stopper member for restricting sliding movement of the movable frame in the axial direction of the first and second platen rollers.

20. A dual type thermal printer according to claim 19; wherein the stopper member is comprised of a conductive material.

* * * * *